United States Patent [19]

Sadamatsu et al.

[11] 4,175,962

[45] Nov. 27, 1979

[54] ELECTROSTATOGRAPHIC TONER MATERIAL

[75] Inventors: Shigeru Sadamatsu, Odawara; Tooru Nozaki; Yoshihiko Yamada, both of Minami-ashigara; Tsuneo Noami, Odawara, all of Japan

[73] Assignee: Rank Xerox, Ltd., London, United Kingdom

[21] Appl. No.: 731,075

[22] Filed: Oct. 12, 1976

[30] Foreign Application Priority Data

Mar. 22, 1976 [JP] Japan ..... 51-029851

[51] Int. Cl.[2] ..... G03G 9/10

[52] U.S. Cl. ..... 430/109; 260/42; 525/122; 430/120

[58] Field of Search ..... 252/62.1; 427/14, 27; 96/15 D; 260/836, 42

[56] References Cited

U.S. PATENT DOCUMENTS

| | | | |
|---|---|---|---|
| 3,449,291 | 6/1969 | Lerman et al. | 260/836 |
| 3,496,250 | 2/1970 | Czerwinski | 260/836 |
| 3,542,711 | 11/1970 | Manasia et al. | 260/836 |
| 3,766,109 | 10/1973 | Pratt et al. | 260/836 |
| 3,788,994 | 1/1974 | Wellman | 252/62.1 P |
| 3,965,021 | 6/1976 | Clemens et al. | 252/62.1 P |
| 4,021,403 | 5/1977 | Fujiwara et al. | 260/836 |

FOREIGN PATENT DOCUMENTS

| | | | |
|---|---|---|---|
| 1233869 | 6/1971 | United Kingdom | 252/62.1 P |

*Primary Examiner*—Michael R. Lusignan
*Assistant Examiner*—Stuart D. Frenkel

[57] ABSTRACT

Developer mixtures comprising finely-divided toner particles electrostatically clinging to the surface of carrier particles. The toner particles comprise a colorant and at least about 60 percent by weight, based on the weight of the toner particles, of a resin mixture comprising between about 40 and about 90 parts by weight of a styrene resin and from about 10 to about 60 parts by weight of an epoxy resin. Electrostatographic imaging processes employing said developer mixtures are also disclosed.

10 Claims, No Drawings

ELECTROSTATOGRAPHIC TONER MATERIAL

BACKGROUND OF THE INVENTION

This invention relates to imaging systems, and more particularly, to improved electrostatographic developing materials, their manufacture and use.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting electrostatic latent image by depositing on the image a finely-divided electroscopic material referred to in the art as "toner". The toner will normally be attracted to those areas of the layer which retain a charge, thereby forming a toner image corresponding to the electrostatic latent image. This toner image may then be transferred to a support surface such as paper. The transferred image may subsequently be permanently affixed to the support surface as by heat or pressure or by a combination of heat and pressure. Instead of latent image formation by uniformly charging the photoconductive layer and then exposing the layer to a light-and-shadow image, one may form the latent image by directly charging the layer in image configuration. The powder image may be fixed to the photoconductive layer if elimination of the powder image transfer step is desired. Other suitable fixing means, such as solvent or overcoating treatment may be substituted for the foregoing heat or pressure fixing steps.

Several methods are known for applying the electroscopic toner particles to the electrostatic latent image to be developed. One development technique, as disclosed by E. N. Wise in U.S. Pat. No. 2,618,552, is known as "cascade" development. In this method, a developer material comprising relatively large carrier particles having finely-divided toner particles electrostatically clinging thereto is conveyed to and rolled or cascaded across the electrostatic latent image-bearing surface. The composition of the carrier particles is so selected as to triboelectrically charge the toner particles to the desired polarity. As the mixture cascades or rolls across the image-bearing surface, the toner particles are electrostatically deposited and secured to the charged portion of the latent image and are not deposited on the discharged or background portions of the image. Most of the toner particles accidentally deposited on the background are removed by the rolling carrier due, apparently, to a greater electrostatic attraction between the toner and the carrier than between the toner and the discharged background area. The carrier and excess toner are then recycled. This technique is extremely good for the development of line copy images.

Another method of developing electrostatic images is the "magnetic brush" process as disclosed, for example, in U.S. Pat. No. 2,874,063. In this method, a developer material containing toner and magnetic carrier particles are carried by a magnet. The magnetic field of the magnet causes alignment of the magnetic carrier into a brush-like configuration. This "magnetic brush" is engaged with the electrostatic image-bearing surface and the toner particles are drawn from the brush to the latent image by electrostatic attraction.

Still another technique for developing electrostatic latent images is the "powder cloud" process as disclosed, for example, by C. F. Carlson in U.S. Pat. No. 2,221,776. In this method, a developer material comprising electrically charged toner particles in a gaseous fluid is passed adjacent to the surface bearing the electrostatic latent image. The toner particles are drawn by electrostatic attraction from the gas to the latent image. This process is particularly useful in continuous toner development.

Other development methods, such as "touchdown" development, as disclosed by R. W. Gundlach in U.S. Pat. No. 3,166,432, may be used where suitable.

Although some of the foregoing development techniques are employed commercially today, the most widely used commercial electrostatographic development technique is the process known as "cascade" development. A general purpose office copying machine incorporating this development method is described in U.S. Pat. No. 3,099,943. The cascade development technique is generally carried out in a commerical apparatus by cascading a developer mixture over the surface of an electrostatic latent image-bearing drum having a horizontal axis. The developer is transported from a trough or sump to the upper portion of the drum by means of an endless belt conveyor. After the developer is cascaded downward along the upper quadrant surface of the drum into the sump, it is recycled through the developing system to develop additional electrostatic latent images. Small quantities of toner are periodically added to the developing mixture to compensate for the toner depleted by development. The resulting toner image is usually transferred to a receiving sheet and thereafter fused by suitable means, such as oven or radiant fusing. The surface of the drum is thereafter cleaned for reuse. The imaging process is then repeated for each copy produced by the machine and is ordinarily repeated many thousands of times during the usable life of the developer.

Thus, it is apparent from the description presented above as well as other development techniques that the toner is subjected to severe mechanical attrition which tends to break down the particles into undesirable dust fines. The formation of fines is retarded when the toner contains a tough, high molecular weight resin which is capable of withstanding the shear and impact forces imparted to the toner in the machine.

Unfortunately, many high molecular weight materials cannot be employed in high speed automatic machines because they cannot be rapidly fused during a powder image heat fixing step. Attempts to rapidly fuse a high melting point toner by means of oversized, high capacity heating units have met with the problems of preventing charring of the paper receiving sheets and of adequately dissipating the heat evolved from the fusing unit or units. Thus, additional equipment, such as complex and expensive cooling units, are necessary to properly dispose of the large quantity of heat generated by the fuser. Imcomplete removal of the heat evolved will result in operator discomfort and damage to heat sensitive machine components. Further, the increased space occupied by and the high operating costs of the heating and cooling units often outweigh the advantages achieved by the increased machine speed. On the other hand, vinyl resins which are easily heat fused at relatively low temperatures are usually undesirable because these materials tend to smear or form thick films on reusable photoconductor surfaces. These films tend to cause image degradation and contribute to machine maintenance down time. Many low molecular weight vinyl resins decompose when subjected to fusing conditions in high speed copying and duplicating machines. In addition, some low melting vinyl resins tend to form tacky images on the copy sheet which are easily smudged and often offset to other adjacent sheets. Moreover, these low molecular weight resins often produce substantial quantities of dust, i.e., sub-micron particles in conventional grinding apparatus which is undesirable in machine operation.

It is also quite important that the toner material which is composed of resin and colorant be capable of accepting a charge of the correct polarity when brought into rubbing contact with the surface of carrier materials in cascade or touchdown development systems. The triboelectric and flow characteristics of many toners are adversely affected by changes in the ambient humidity. For example, the triboelectric values of some toners fluctuate with changes in relative humidity and are not desirable for employment in electrostatographic systems, particularly in precision automatic machines which require toners having stable and predictable triboelectric values. Therefore, resins useful for toner applications should be insensitive to variations in relative humidity. Another factor affecting the stability of carrier triboelectric properties is the tendency of some toner materials to "impact" on the surface of carrier particles. When developers are employed in automatic cascade developing machines and recycled through many cycles, the many collisions which occur between the carrier and toner particles in the machine cause the toner particles carried on the surface of the carrier particles to be welded or otherwise forced into the surface of the carrier particles. The gradual accumulation of permanently attached toner material on the surface of carrier particles causes a change in the triboelectric value of the carrier particles and directly contributes to the degradation of copy quality of eventual destruction of the toner carrying capacity of the carrier.

In addition, the xerographic copies produced must possess good line image contrast and solid area coverage. However, when it is desired to improve either line image contrast or solid area density, one of these properties suffers in quality. Further, in an automatic copying device, increasing the density of images generally results in an increase in the amount of toner material adhering to the background portion of the image causing copies of poor quality. To eliminate this defect, xerographic copying is usually designed to minimize background density by reducing the toner concentration in the developer mixture. However, when copying an original having a very low image density with such a developer mixture, the original can only be reproduced as to have a very low image density and line copy is interrupted providing a substantial failure in copy quality. When it is attempted to increase the image density of the copy by increasing the toner concentration, the background portion of the copy is heavily soiled by excessive toner deposit therein.

Numerous known carriers and toners are abrasive in nature. Abrasive contact between toner particles, carriers, and electrostatographic imaging surfaces accelerates mutual deterioration of these components. Replacement of carriers and electrostatic image-bearing surfaces is expensive and time consuming.

Since most developer materials are deficient in one or more of the above areas, there is a continuing need for improved toners and developers.

It is, therefore, an object of this invention to provide developer compositions which overcome the above-noted deficiencies.

It is another object of this invention to provide a toner which is stable at toner fusing conditions in high speed copying and duplicating machines.

It is another object of this invention to provide a toner composition which can be fused at higher rates with less heat energy.

It is another object of this invention to provide a toner which is triboelectrically stable under varying humidity conditions.

It is another object of this invention to provide a toner composition which is more resistant to blocking in storage and use.

It is another object of this invention to provide a toner material which is readily removable by carriers from image background areas during image development even when it is present in an increased concentration in a developer mixture.

It is another object of this invention to provide a toner material which will resist smearing and be more easily cleaned from electrostatic imaging surfaces.

It is another object of this invention to provide a toner and developer composition having physical and chemical properties superior to those of known toners and developers.

These, as well as other objects, are accomplished by the present invention, generally speaking, by providing finely-divided particulate toner compositions comprising a colorant and at least about 60 percent by weight, based on the weight of the toner compositions, of a resin mixture comprising between about 40 and about 90 parts by weight of a styrene resin and from about 10 to about 60 parts by weight of an epoxy resin. It has now been found that the properties desired of developer materials may be attained by employing toner materials having the foregoing compositions. In order to obtain even better results, it is preferred that the amount of styrene resin in the toner compositions be from between about 50 and 80 parts by weight of the resin mixture. Optimum results are obtained when the amount of styrene resin in the toner compositions is from between about 70 and about 90 parts by weight of the resin mixture.

In accordance with this invention, it has been found that the use of styrene resin alone in a toner composition will usually provide the advantages that the toner material will generate a stable triboelectric charge during the early stages of electrostatographic development with the resulting copies being of high quality. Such a toner material is also resistant to changes in triboelectric charging values even when the atmospheric relative humidity rises. Further, a toner composition employing styrene alone as the resin component has good pulverizability when the styrene has a moderately high molecular weight.

However, a toner composition containing only styrene as the resin component suffers from the drawback that as the molecular weight of the styrene resin increases, the fusion temperature of the resultant toner material must be elevated to very high levels. When the molecular weight of the styrene is decreased as to lower the fusion temperature of the toner material, it has been found that the toner material agglomerates and blocks even at room temperature. Further, when the concentration of a toner material containing only styrene as the resin component is increased in the developing process, considerable adherence of the toner material to the image background areas results. In addition, after repeating the copying process for long periods of time, it is found that such a toner material adheres markedly to the surface of the carrier particles causing deterioration in the quality of the copies. Finally, such a toner material becomes finely divided into dust and fines by collisions with the carrier material even after use for short periods of time.

It has further been found that the use of an epoxy resin as the resin component of a toner material will provide a toner material having stable triboelectric charge values when the epoxy resin has a moderate molecular weight and the resultant copies are of high quality. Such a toner material also has good fixability and can be easily fused to a substrate such as paper even at low temperatures. However, the use of epoxy alone as the resin component of a toner material which has been selected as to have a satisfactory triboelectric charging level will provide a toner material which agglomerates when allowed to stand at room temperature. A toner material based on epoxy alone as the resin component where the molecular weight of the epoxy has been selected so that the toner material will not agglomerate at room temperature does not provide satisfactory triboelectric charging values and the resulting copy is of poor quality. Further, increasing the concentration of such a toner material in a developer mixture causes marked adhesion of the toner material to the background areas of a developed image. Finally, such a toner material selected as to possess satisfactory triboelectric charging properties will also become finely divided into dust and fines due to collisions with the carrier material and the machine surfaces even after short periods of use.

In accordance with the present invention, it has been found that the mixture of epoxy and styrene resins of the toner composition of this invention provides the advantages of the constituent resins without retaining the drawbacks of these resins for use in toner compositions. That is, such toner compositions have an entirely satisfactory fusion temperature range and they do not agglomerate or block at room temperature. Furthermore, such toner compositions do not substantially impact on carrier surfaces even after repeated copying for long periods of time and the resulting copies are of high quality. Even when the toner concentration in the developer mixture is increased as in copying originals having a low optical density, there is practically no adhesion of the toner material to the background areas of the image copy. In addition, these toner materials are not noticeably pulverized by the numerous collisions with the carrier materials and machines surfaces even in long-term copying operations and thus provide copies of high quality.

No theoretical explanation can be made for the above findings. Suffice it to say that the propertions of the styrene resin and the epoxy resin should be within the specified ranges, and outside these ranges, the combined effect on the toner material is hardly noticeable. Thus, when the ratio of styrene resin to epoxy resin exceeds 4:6 to 9:1, that is, when the amount of styrene resin is below 40 percent by weight in the resin mixture, the resulting toner material will usually not produce so great an effect on lack of deposition of toner material to the copy background areas when the toner concentration in the developer mixture is increased. Likewise, when the amount of styrene resin exceeds 90 percent by weight in the resin mixture, the aforementioned effect is lost, and simultaneously, the effect of the epoxy resin on the fusion temperature of the toner material is lost. Therefore, to obtain the advantages enumerated above, the styrene and epoxy resin mixture in the toner compositions should be in the given amounts and ratios. In addition, when the amount of the above-mentioned mixture is less than about 60 percent by weight based on the entire weight of the toner composition, the above-mentioned advantages are substantially lost. When the styrene and epoxy resin mixture of this invention is present in the toner composition in an amount of at least about 60 percent by weight, various polymers and additives can be incorporated therein.

Any suitable styrene resin may be employed in the toner compositions of this invention. Typical styrene resins include the homopolymers of styrene, styrene copolymers containing at least about 80 percent by weight of a styrene unit with vinyl monomer other than substituted styrene, copolymers containing at least about 70 percent by weight of a styrene unit and substituted styrene, and polystyrene. These polymers retain the characteristics of styrene suitable for use in the present invention. Preferably, the styrene resins used have a molecular weight of between about 1,000 and about 30,000. Those styrene resins having a molecular weight above 30,000 may have too high a fusion temperature. Likewise, those styrene resins having a molecular weight below 1,000 are typically liquids and it is very difficult to produce the desired toner material therewith. However, it is possible to mix a styrene resin having a high molecular weight with a styrene resin having a low molecular weight to adjust the fusion temperature thereof at a moderate point. In addition, if a high molecular weight styrene resin is employed, a plasticizer may be conveniently mixed therewith.

Any suitable epoxy resin may be employed in the toner compositions of this invention. Typical epoxy resins include those having a molecular weight of between about 500 and about 10,000. The considerations involved with the use of the styrene resin discussed above are equally applicable with respect to the epoxy resin used.

Any suitable pigment or dye can be employed as the colorant for the toner particles. Toner colorants are well known and include, for example, carbon black, nigrosine dye, aniline blue, Calco Oil Blue, chrome yellow, ultra marine blue, Quinoline Yellow, methylene blue chloride, Monastral Blue, Malachite Green Oxalate, lampblack, Rose Bengal, Monastral Red, Sudan Black BN, and mixtures thereof. The pigment or dye, or pigment and dye, should be present in the toner in a sufficient quantity to render it highly colored so that it will form a clearly visible image on a recording member. Thus, for example, where conventional electrostatographic copies of typed documents are desired, the toner may comprise a black pigment, such as carbon black, or a black dye, such as Sudan Black BN dye available from GAF Corporation. Preferably, for sufficient color density, the pigment is employed in an amount from about 1 percent to about 20 percent by weight, based on the total weight of the colored toner. If the toner colorant employed is a dye, substantially smaller quantities of colorant may be used. The colorants may be mixed with the resin component prior to, during, or after the resin component is polymerized. Obviously, any colorant which inhibits polymerization should be blended with the resin after the resin is formed.

The toner compositions of the present invention can be prepared by any well-known toner mixing and comminution technique. For example, the ingredients can be thoroughly mixed by blending and milling the components and thereafter micropulverizing the resulting mixture. Another well-known technique for forming toner particles is to spray dry or freeze dry a suspension, a hot melt, or a solution of the toner composition.

The toner compositions of this invention may contain up to about 35 percent, based on the total weight of the toner, of other polymeric substances, plasticizers and other additives in addition to the mixture of the styrene and epoxy resin and the pigment or dye. Examples of such other polymeric substances are polymethacrylate ester resins, polyethylene resins, polybutadiene resins, polyvinyl chloride resins, polyether resins, polyester resins, rosin-modified formaldehyde resins, polyurethane resins, paraffins, silicone resins, chlorinated paraffins, and natural rubbers. These polymeric substances may be added in amounts which impart their own advantages to the toner material and do not impair the advantages of the toner composition of this invention as described above.

When the toner compositions of this invention are to be employed in cascade development processes, the toner should have an average particle diameter less than about 30 microns, and preferably between about 3 and about 15 microns for optimum results in magnetic brush development processes. For use in powder cloud development methods, particle diameters of slightly less than 1 micron are preferred.

Suitable coated and uncoated carrier materials for cascade and magnetic brush development are well known in the art. The carrier particles can be electrically conductive, insulating, magnetic or non-magnetic, provided that the carrier particles acquire a charge having an opposite polarity to that of the toner particles when brought into close contact with the toner particles so that the toner particles adhere to and surround the carrier particles. When a positive reproduction of an electrostatic image is desired, the carrier particle is selected so that the toner particles acquire a charge having a polarity opposite to that of the electrostatic latent image. Alternatively, if a reversal reproduction of the electrostatic image is desired, the carriers are selected so that the toner particles acquire a charge having the same polarity as that of the electrostatic image. Thus, the materials for the carrier particles are selected in accordance with their triboelectric properties in respect to the electroscopic toner so that when mixed or brought into mutual contact, one component of the developer is charged positively, if the other component is below the first component in the triboelectric series and negatively, if the other component is above the first component in the triboelectric series. By proper selection of materials in accordance with their triboelectric effects, the polarities of their charge when mixed, are such that the electroscopic toner particles adhere to and are coated on the surfaces of carrier particles and also adhere to that portion of the electrostatic image-bearing surface having a greater attraction for the toner than the carrier particles. Typical carriers include sodium chloride, ammonium chloride, aluminum potassium chloride, Rochelle salt, sodium nitrate, aluminum nitrate, potassium chlorate, granular zircon, granular silicon, methyl methacrylate, glass, silicon dioxide, iron and alloys thereof, nickel, steel, ferrites, and the like. The carriers can be employed with or without a coating. Many of the foregoing and typical carriers are described by L. E. Walkup in U.S. Pat. No. 2,618,551, L. E. Walkup et al in U.S. Pat. No. 2,638,416, and E. N. Wise in U.S. Pat. No. 2,618,552. An ultimate carrier particle diameter between about 50 microns and about 1,000 microns is preferred because the carrier particles then possess sufficient density and inertia to avoid adherence to the electrostatic images during the development process. Adherence of carrier beads to electrostatographic drum surfaces is undesirable because of the formation of deep scratches on the surface during the image transfer and drum cleaning steps, particularly where cleaning is accomplished by a web cleaner such as the web disclosed by W. P. Graff, Jr. et al in U.S. Pat. No. 3,186,838. Also, print deletion occurs when carrier beads adhere to electrostatographic imaging surfaces. Generally speaking, satisfactory results are obtained when about 1 part toner is used with about 10 to about 200 parts by weight of carrier.

The toner compositions of the present invention can be employed to develop electrostatic latent images on any suitable electrostatic latent image-bearing surface including conventional photoconductive surfaces as well as insulating surfaces. Well-known photoconductive materials include vitreous selenium, organic or inorganic photoconductors embedded in a non-photoconductive matrix, and the like. Representative patents in which photoconductive materials are disclosed include U.S. Pat. No. 2,803,542 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

DESCRIPTION OF THE PREFERRED EMBODIMENTS

The following examples further define, describe, and compare methods of preparing the toner materials of the present invention and of utilizing them to develop electrostatic latent images. These examples, other than the control examples, are intended to illustrate the various preferred embodiments of the present invention. Parts and percentages are by weight unless otherwise indicated.

EXAMPLE I

About 1.8 parts of polystyrene (D-125, available from Pennsylvania Industrial Chemicals Company) and about 0.2 parts of carbon black were well mixed and then introduced under pressure into an intensive mixer at a hydraulic pressure of about 7 $Kg/cm^2$ and a compressor pressure of about 5.0 $Kg/cm^2$. The mixture was kneaded for about 10 minutes while maintaining the temperature inside of the mixer at about 80° C. The kneaded mixture was taken out of the mixer, cooled, and suitably broken. The broken mixture was coarsely pulverized by a free mill to a size of several hundred microns, and then finely pulverized by a jet-mixer at a pneumatic pressure of about 6.3 $Kg/cm^2$ while feeding the coarsely pulverized particles at a rate of about 1.6 Kg/hour thereby to form a fine toner powder having an average particle size of about 12 microns.

A copy of a standard test pattern was prepared in a 2200 Xerox copying machine using the resulting toner powder. Examination of the resulting copy by a line densitometer showed that when a fine line of grey with a density of about 0.7 is reproduced in a density of about 0.9, the density of the background is about 0.01, and when it is reproduced in a density of about 1.2, the background density is about 0.04. The copy exhibited a soiled appearance. The copying was repeated about 5,000 times and the background density became about 0.04 when the same pattern as above was reproduced in a density of about 0.9, and more than about 0.05 when it was reproduced in a density of about 1.2. The copies obtained were very soiled.

EXAMPLE II

About 1.5 parts of polystyrene (D-125, available from Pennsylvania Industrial Chemicals Company) and about 0.3 parts of an epoxy resin (E-1001, a product of Shell Chemical Co.), and 0.2 parts of carbon black were well mixed, kneaded, and pulverized in the same way as in Example I to form a toner powder.

The same test as in Example I was performed using a 2200 Xerox copying machine. It was found that the background density was about 0.01 when the pattern was reproduced in a density of about 0.9; about 0.005 when it was reproduced in a density of about 1.2; and about 0.005 when it was reproduced in a density of about 1.6. The copy was clear. When the same test was performed for about 20,000 copying cycles, the background density was about 0.01 when the pattern was reproduced in a density of about 0.9; about 0.01 when it was reproduced in a density of about 1.2; and about 0.005 when it was reproduced in a density of about 1.6. Thus, no substantialy change in background density was evident with this toner composition.

EXAMPLE III

About 1.1 parts of polystyrene (ST-120, a product of Sanyo Kasei), about 0.9 parts of an epoxy resin (E-1002, a product of Shell Chemical Co.) and about 0.2 parts of carbon black were well mixed, kneaded, and pulverized in the same way as in Example I to form a toner powder.

The same test as in Example I was performed using a 2200 Xerox copying machine. It was found that when the pattern was reproduced in a density of about 0.9, the background density became about 0.01; it was about 0.01 when the pattern was reproduced in a density of about 1.2; and it became about 0.005 when the pattern was reproduced in a density of about 1.6. After about 20,000 copying cycles, there was substantially no quality change since the background density was about 0.01 for the reproduced density of about 0.9; about 0.01 for the reproduced density of about 1.2; and about 0.01 for the reproduced density of about 1.6.

EXAMPLE IV

About 0.3 parts of polystyrene (ST-75, a product of Sanyo Kasei), about 1.2 parts of polystyrene (ST-120, a product of Sanyo Kasei), about 0.3 parts of an epoxy resin (E-1002, a product of Shell Chemical Co.), and about 0.2 parts of carbon black were well mixed, kneaded, and pulverized in the same way as in Example I to form a toner powder.

The same test as in Example I was performed using a 2200 Xerox copying machine. It was found that the background density became about 0.005 for the reproduced density and about 0.9; about 0.005 for the reproduced density of about 1.2; and about 0.01 for the reproduced density of about 1.6. After about 20,000 copying cycles, there was substantially no quality change since the background density was about 0.01 for the reproduced density of about 0.9; about 0.005 for the reproduced density of about 1.2; and about 0.01 for the reproduced density of about 1.6.

EXAMPLE V

About 1.6 parts of polystyrene (ST-120, a product of Sanyo Kasei), about 0.2 parts of an epoxy resin (E-1002, a product of Shell Chemical Co.) and about 0.2 parts of carbon black were well mixed, kneaded, and pulverized in the same way as in Example I to form a toner powder.

The same test was performed as in Example I using a 2200 Xerox copying machine. The background density became about 0.01 for the reproduced density of about 0.9, and about 0.005 for the reproduced density of about 1.6. After about 20,000 copying cycles, the background density became about 0.01 for the reproduced density of about 0.9; and about 0.01 for the reproduced density of about 1.6. There was no substantial change observed in copy quality.

EXAMPLE VI

About 1.2 parts of a copolymer composed of about 25 parts by weight of a chlorostyrene unit and about 75 parts by weight of a styrene unit, about 0.6 parts of an epoxy resin (E-1004, a product of Shell Chemical Co.), and about 0.2 parts of carbon black were well mixed, kneaded, and pulverized in the same way as in Example I to form a toner powder.

The same test as in Example I was performed using a 2200 Xerox copying machine. It was found that the background density was about 0.005 for the reproduced density of about 0.9; and about 0.005 for the reproduced density of about 1.6. After about 20,000 copying cycles, the background density was found to be about 0.005 for the reproduced density of about 0.9 and about 0.01 for the reproduced density of about 1.6. There was no substantial change observed in copy quality.

EXAMPLE VII

About 1.3 parts of polystyrene (ST-120, a product of Sanyo Kasei), about 0.5 parts of an epoxy resin (E-1001, a product of Shell Chemical Co.), about 0.2 parts of poly(n-butyl methacrylate) (Elvacite 2044, a product of DuPont), and about 0.2 parts of carbon black were well mixed, kneaded, and pulverized in the same way as in Example I.

The same test as in Example I was performed using a 2200 Xerox copying machine. It was found that the background density was about 0.01 for the reproduced densities of about 0.9, 1.2, and 1.6. After about 20,000 copying cycles, there was substantially no change in background density, it being about 0.01 for the reproduced densities of about 0.9, 1.2, and 1.6.

EXAMPLE VIII

About 1.2 parts of a copolymer composed of about 85 parts by weight of a styrene unit and about 15 parts by weight of an isobutyl methacrylate unit, about 0.6 parts of an epoxy resin (E-1002, a product of Shell Chemical Co.), and about 0.2 parts of carbon black were well mixed, kneaded, and pulverized in the same way as in Example I to form a toner powder.

The same test as in Example I was performed using a 2200 Xerox copying machine. It was found that the background density was about 0.005 for the reproduced density of about 0.9; about 0.005 for the reproduced density of about 1.2; and about 0.01 for the reproduced density of about 1.6. After about 20,000 copying cycles, no substantial change was observed in background density since it was about 0.005 for the reproduced density of about 0.9; about 0.01 for the reproduced density of about 1.2; and about 0.01 for the reproduced density of about 1.6.

The expression "developer mixture" as employed herein is intended to include electroscopic toner material or combinations of toner material and carrier material.

Although specific materials and conditions are set forth in the foregoing examples, these are merely intended as illustrations of the present invention. Various other suitable additives, colorants, and other components, such as those listed above, may be substituted for those in the examples with similar results. Other materials may also be added to the toner to sensitize, synergize, or otherwise improve the fusing properties or other desirable properties of the system.

Other modifications of the present invention will occur to those skilled in the art upon a reading of the present disclosure. These are intended to be included within the scope of this invention.

What is claimed is:

1. An electrostatographic developer mixture comprising finely-divided toner particles electrostatically clinging to the surface of carrier particles, said toner particles comprising from between about 1 percent and about 20 percent by weight of a colorant based on the weight of said particles, and at least about 60 percent by weight, based on the weight of said toner particles, of a homogeneous resin mixture consisting essentially of between about 40 and about 90 parts by weight of a styrene resin and from about 10 to about 60 parts by weight of an epoxy resin, said styrene resin having a molecular weight of between about 1,000 and about 30,000, and said epoxy resin having a molecular weight of between about 500 and about 10,000.

2. An electrostatographic developer mixture in accordance with claim 1 wherein the amount of said styrene resin is from between about 50 and about 80 parts by weight of said resin mixture.

3. An electrostatographic developer mixture in accordance with claim 1 wherein said colorant is selected from the group consisting of a pigment and a dye.

4. An electrostatographic developer mixture in accordance with claim 1 wherein said toner particles have an average particle diameter of less than about 30 microns.

5. An electrostatographic developer mixture in accordance with claim 1 wherein said toner particles are present in an amount of about 1 part per 10 to 200 parts by weight of said carrier particles.

6. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of carrier particles, said toner particles comprising from between about 1 percent and about 20 percent by weight of a colorant based on the weight of said toner particles, and at least about 60 percent by weight, based on the weight of said toner particles, of a homogeneous resin mixture consisting essentially of between about 40 and about 90 parts by weight of a styrene resin and from about 10 to about 60 parts by weight of an epoxy resin, said styrene resin having a molecular weight of between about 1,000 and about 30,000, and said epoxy resin having a molecular weight of between about 500 and about 10,000, whereby at least a portion of said finely-divided toner particles are attracted to and deposited on said recording surface in conformance with said electrostatic latent image.

7. An electrostatographic imaging process in accordance with claim 6 wherein the amount of said styrene resin is from between about 50 and about 80 parts by weight of said resin mixture.

8. An electrostatographic imaging process in accordance with claim 6 wherein said colorant is selected from the group consisting of a pigment and a dye.

9. An electrostatographic imaging process in accordance with claim 6 wherein said toner particles have an average particle diameter of less than about 30 microns.

10. An electrostatographic imaging process in accordance with claim 6 wherein said toner particles are present in an amount of about 1 part per 10 to 200 parts by weight of said carrier particles.

* * * * *